US006715840B2

(12) United States Patent
Martin

(10) Patent No.: US 6,715,840 B2
(45) Date of Patent: Apr. 6, 2004

(54) FURNITURE SUPPORT SYSTEM

(76) Inventor: Ray O. Martin, 2219 Main Ave., Suite A, Fargo, ND (US) 58103

( * ) Notice: Subject to any disclaimer, the term of this patent is extended or adjusted under 35 U.S.C. 154(b) by 78 days.

(21) Appl. No.: 09/995,163

(22) Filed: Nov. 26, 2001

(65) Prior Publication Data

US 2002/0093237 A1 Jul. 18, 2002

Related U.S. Application Data

(60) Provisional application No. 60/261,462, filed on Jan. 12, 2001.

(51) Int. Cl.[7] ..... A47B 97/00
(52) U.S. Cl. ..... 297/463.1
(58) Field of Search ..... 297/463.1, 463.2; 248/188.2, 188.8, 188.9, 346.11, 346.01; 108/147.21

(56) References Cited

U.S. PATENT DOCUMENTS 233,843 A * 11/1880 Estabrooks
280,593 A * 7/1883 Farmer
1,798,272 A * 3/1931 Phillips
1,886,112 A * 11/1932 Luarde
2,097,332 A * 10/1937 Krumhar et al.
2,366,867 A * 1/1945 Nichthauser
2,750,709 A * 6/1956 Saverino
2,893,164 A * 7/1959 Martin
2,933,754 A * 4/1960 Winans
3,138,893 A * 6/1964 Rupar
3,232,253 A * 2/1966 Winters
4,919,386 A * 4/1990 Cassina
5,333,825 A * 8/1994 Christensen
5,345,631 A * 9/1994 Saperstein et al.
5,647,286 A * 7/1997 Dunn
5,899,422 A * 5/1999 Eke

* cited by examiner

*Primary Examiner*—Milton Nelson, Jr.

(57) ABSTRACT

A furniture support system for elevating and angling furniture to assist individuals in standing up from a seated position. The furniture support system includes at least one first support member, and at least one second support member wherein the first support member is shorter in height than the second support member. The support members are preferably constructed of a tapered structure with a broad lower end and a narrow upper end. At the upper end of each of the support members a cavity extends downwardly for receiving the leg of furniture member. A support plate may be attached to the bottom edge of a couch or other type of furniture that does not contain legs to ensure proper placement with the cavities of the support members.

20 Claims, 10 Drawing Sheets

FURNITURE SUPPORT SYSTEM

CROSS-REFERENCE TO RELATED U.S. PATENT APPLICATION

I hereby claim benefit under Title 35, United States Code, Section 119(e) of U.S. provisional patent application Ser. No. 60/261,462 filed Jan. 12, 2001. This application is a continuation of the 60/261,462 application. The 60/261,462 application is currently pending. The 60/261,462 application is hereby incorporated by reference into this application.

BACKGROUND OF THE INVENTION

1. Field of the Invention

The present invention relates generally to furniture adaptive devices and more specifically it relates to a furniture support system for elevating and angling furniture to assist individuals in standing up from a seated position.

Many individuals find it difficult to elevate themselves from a sitting position upon furniture to an elevated standing position because of various types of disabilities such as arthritis, Parkinson's, multiple sclerosis, Alzheimer's, heart problems, lung problems, overweight, physical injuries and other conditions. In addition, individuals that are elderly, pregnant or recovering from surgery find it difficult sometimes to elevate themselves from a seated position. There is therefore a need for an invention that allows individuals to freely elevate themselves from furniture such as chairs and couches without the assistance of third parties.

2. Description of the Prior Art

Elevating chairs have been in use for years. Elevating chairs are typically comprised of a chair having a base structure that is capable of elevating the chair upwardly and forwardly when an individual desires to leave the chair. These elevating chairs generally are expensive and do not allow an individual to utilize their existing furniture to save money. Also, many individuals like to utilize their existing furniture because of aesthetic issues that are difficult to accomplish with conventional elevating chairs. Conventional elevating chairs are also often times difficult to utilize by individuals.

Examples of patented support devices which are illustrative of such prior art include U.S. Pat. No. 2,893,164 to Martin; U.S. Pat. No. 1,230,187 to McClelland; U.S. Pat. No. 1,655,611 to Jensen; U.S. Pat. No. 2,366,867 to Nichthauser; U.S. Pat. No. 1,798,272 to Phillips; U.S. Pat. No. 5,333,825 to Christensen; U.S. Pat. No. 4,979,718 to Bauer; and U.S. Pat. No. 3,298,646 to Van Buren are all illustrative of such prior art. None of these patented support devices teach a furniture elevating system that angles the furniture forwardly in combination with elevating the furniture. In addition, none of the patented support devices teach a system that is suitable for supporting furniture that does not contain legs.

While these devices may be suitable for the particular purpose to which they address, they are not as suitable for elevating and angling furniture to assist individuals in standing up from a seated position. Conventional elevating chair devices are expensive and sometimes difficult for individuals to utilize. In addition, conventional elevating chair devices do not allow an individual to utilize their existing furniture.

In these respects, the furniture support system according to the present invention substantially departs from the conventional concepts and designs of the prior art, and in so doing provides an apparatus primarily developed for the purpose of elevating and angling furniture to assist individuals in standing up from a seated position.

SUMMARY OF THE INVENTION

In view of the foregoing disadvantages inherent in the known types of furniture elevating devices now present in the prior art, the present invention provides a new furniture support system construction wherein the same can be utilized for elevating and angling furniture to assist individuals in standing up from a seated position.

The general purpose of the present invention, which will be described subsequently in greater detail, is to provide a new furniture support system that has many of the advantages of the furniture elevating devices mentioned heretofore and many novel features that result in a new furniture support system which is not anticipated, rendered obvious, suggested, or even implied by any of the prior art furniture elevating devices, either alone or in any combination thereof.

To attain this, the present invention generally comprises at least one first support member, and at least one second support member wherein the first support member is shorter in height than the second support member. The support members are preferably constructed of a tapered structure with a broad lower end and a narrow upper end. At the upper end of each of the support members a cavity extends downwardly for receiving the leg of furniture member. A support plate may be attached to the bottom edge of a couch or other type of furniture that does not contain legs to ensure proper placement with the cavities of the support members.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a furniture support system that will overcome the shortcomings of the prior art devices.

A second object is to provide a furniture support system for elevating and angling furniture to assist individuals in standing up from a seated position.

Another object is to provide a furniture support system that provides a comfortable support position for individuals.

An additional object is to provide a furniture support system that reduces the likelihood of injury for individuals attempting to standup from a seated position.

A further object is to provide a furniture support system that can be utilized upon various types of furniture such as but not limited to chairs, beds and couches.

Another object is to provide a furniture support system that may be utilized upon furniture with or without legs.

A further object is to provide a furniture support system that is portable for allowing usage by individuals traveling from their home.

Another object is to provide a furniture support system that may be compactly stored.

An additional object is to provide a furniture support system that are capable of supporting significant weight.

A further object is to provide a furniture support system that supports furniture in a stable and secure manner.

Another object is to provide a furniture support system that elevates furniture to a height so that disabled and other individuals to not require assistance in sitting upon the furniture.

Another object is to provide a furniture support system that can be easily positioned under existing furniture and easily removed from existing furniture.

A further object is to provide a furniture support system that allows an individual to utilize their existing furniture.

Another object is to provide a furniture support system that is constructed of a strong and lightweight structure.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
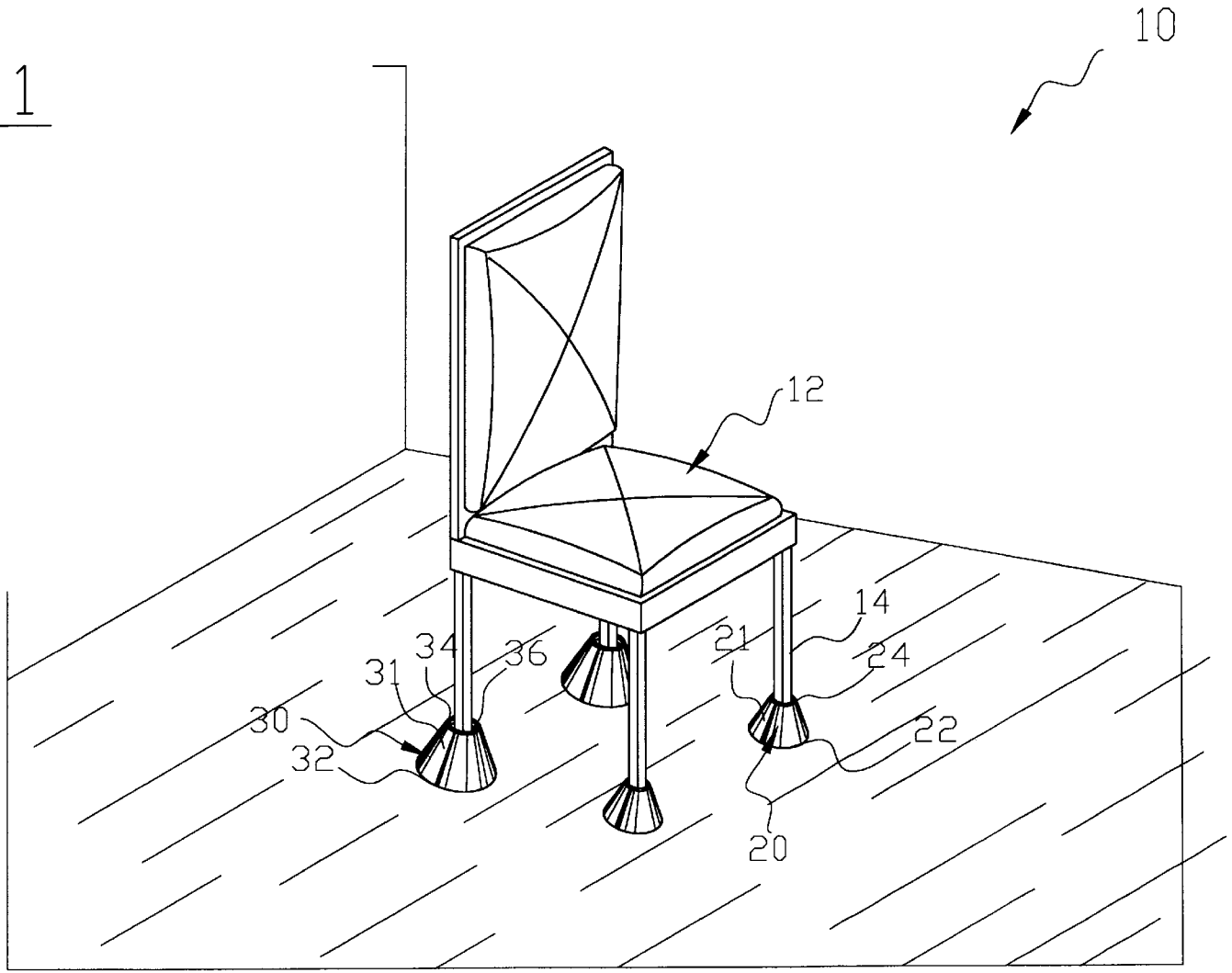
FIG. 1 is an upper perspective view of the present invention positioned beneath a chair.

Turning now descriptively to the drawings, in which similar reference characters denote similar elements throughout the several views, FIGS. 1 through 10 illustrate a furniture support system 10, which comprises at least one first support member 20, and at least one second support member 30 wherein the first support member 20 is shorter in height than the second support member 30. The support members 20, 30 are preferably constructed of a tapered structure with a broad lower end and a narrow upper end. At the upper end of each of the support members 20, 30 a cavity 26, 36 extends downwardly for receiving the leg of furniture member. A support plate 40 may be attached to the bottom edge 18 of a couch 16 or other type of furniture that does not contain legs 14 to ensure proper placement with the cavities of the support members 20, 30.

Figure 2:
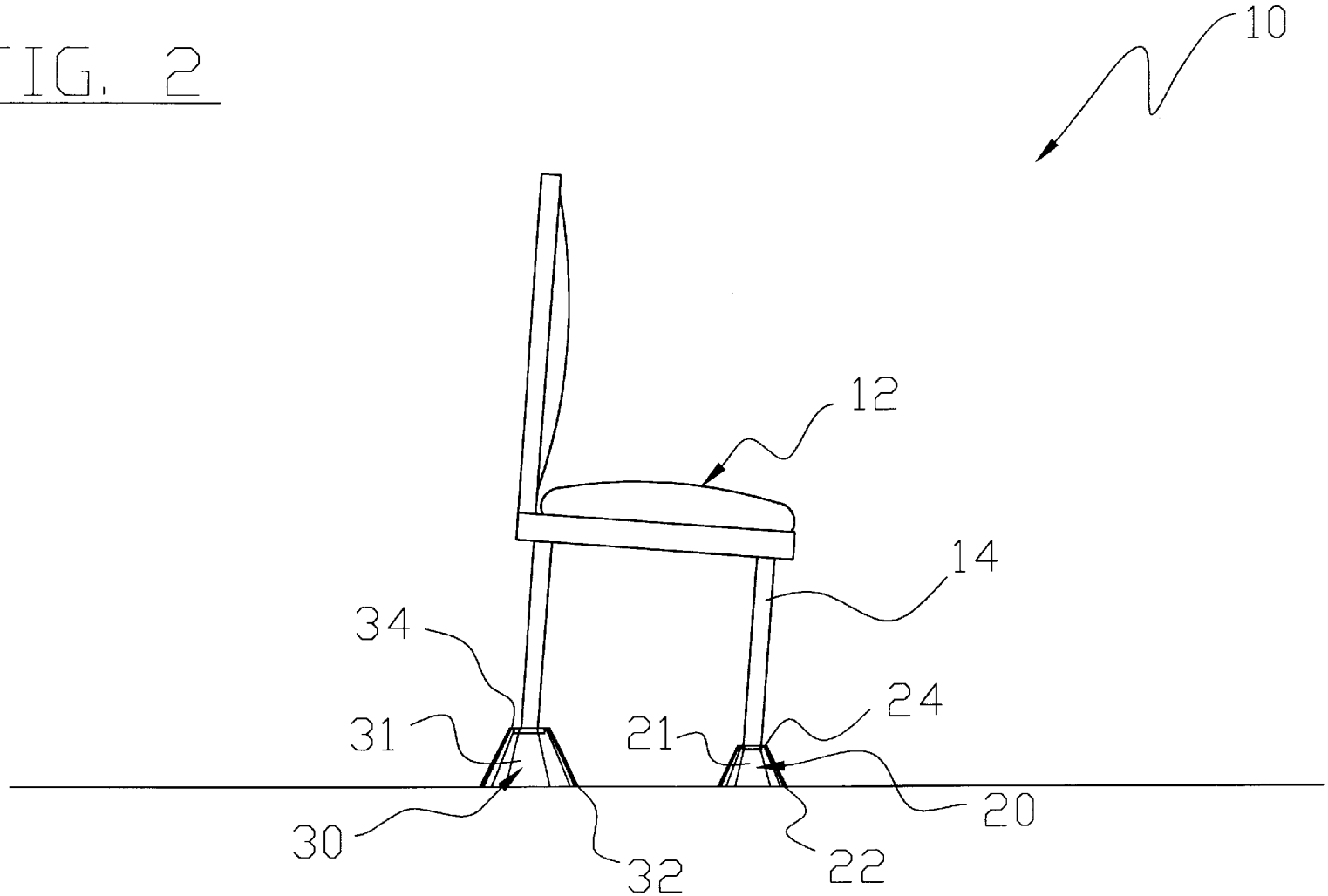
FIG. 2 is a side view of the present invention positioned beneath a chair.
Figure 3:
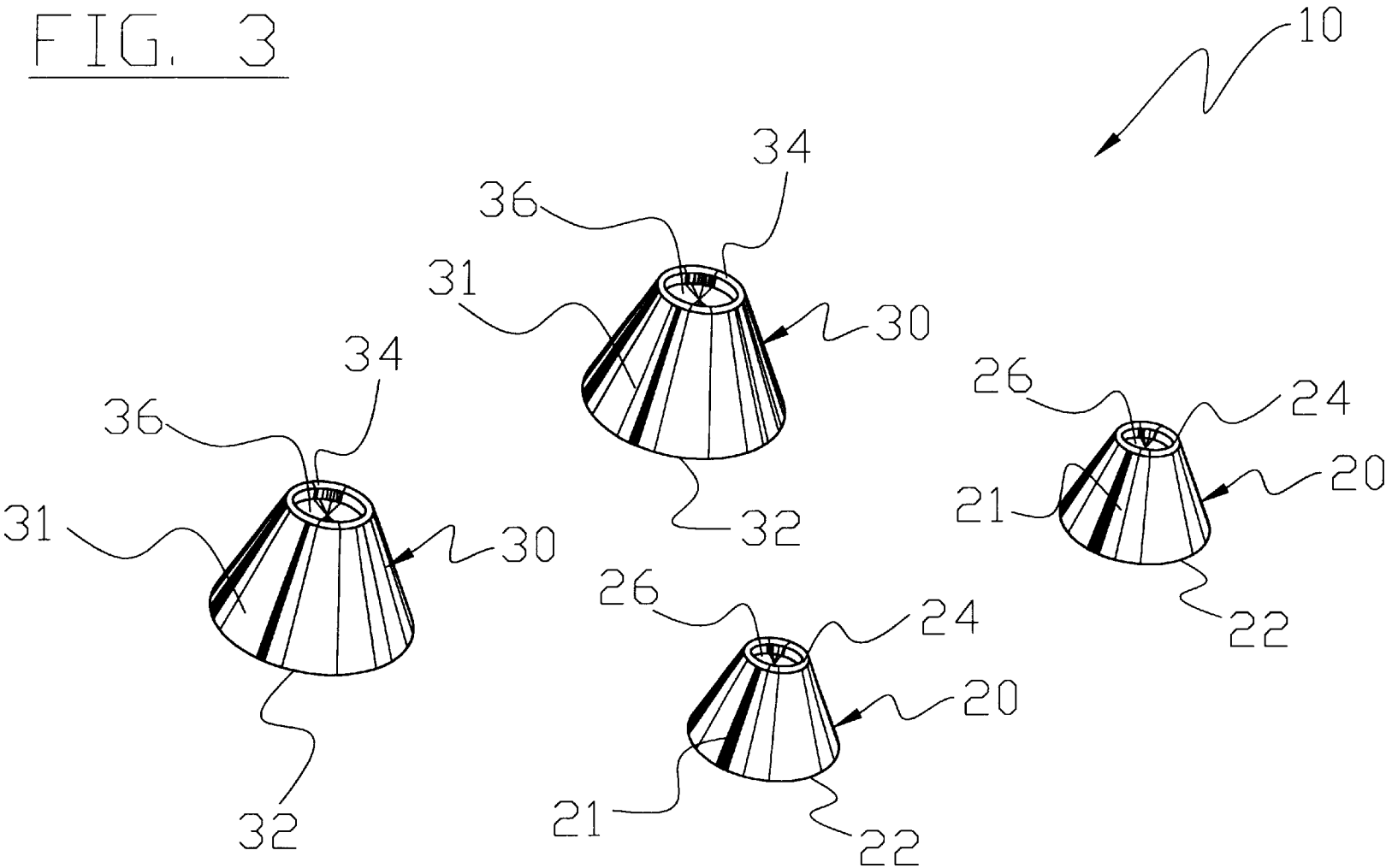
FIG. 3 is an upper perspective view of the present invention.
Figure 4:
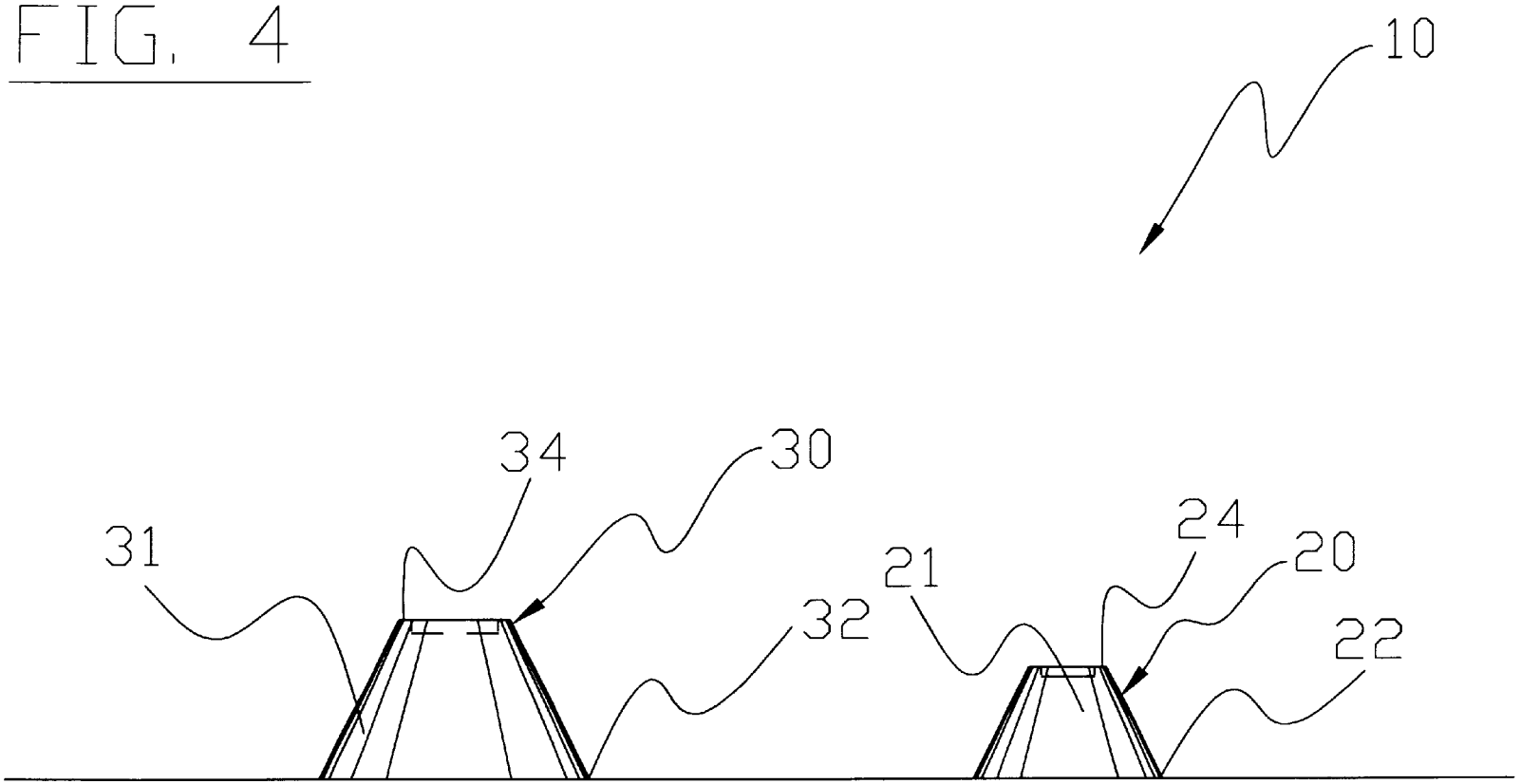
FIG. 4 is a side view of the first support member and the second support member.

As shown in FIGS. 1 through 5 of the drawings, each first support member 20 is comprised of a tapered structure having a first support wall 21, a broad first lower end 22 and a narrower first upper end 24. The first lower end 22 is significantly broader than the first upper end 24 as best illustrated in FIG. 4 of the drawings. The first support member 20 preferably has a conical shape, other tapered shapes may be utilized to construct the first support member 20 as can be appreciated. The first support member 20 is preferably constructed of a strong and lightweight material such as but not limited to plastic. The first support member 20 may be painted to match the surrounding furniture or the material utilized to construct the first support member 20 may be colored to the desired color.

Figure 6:
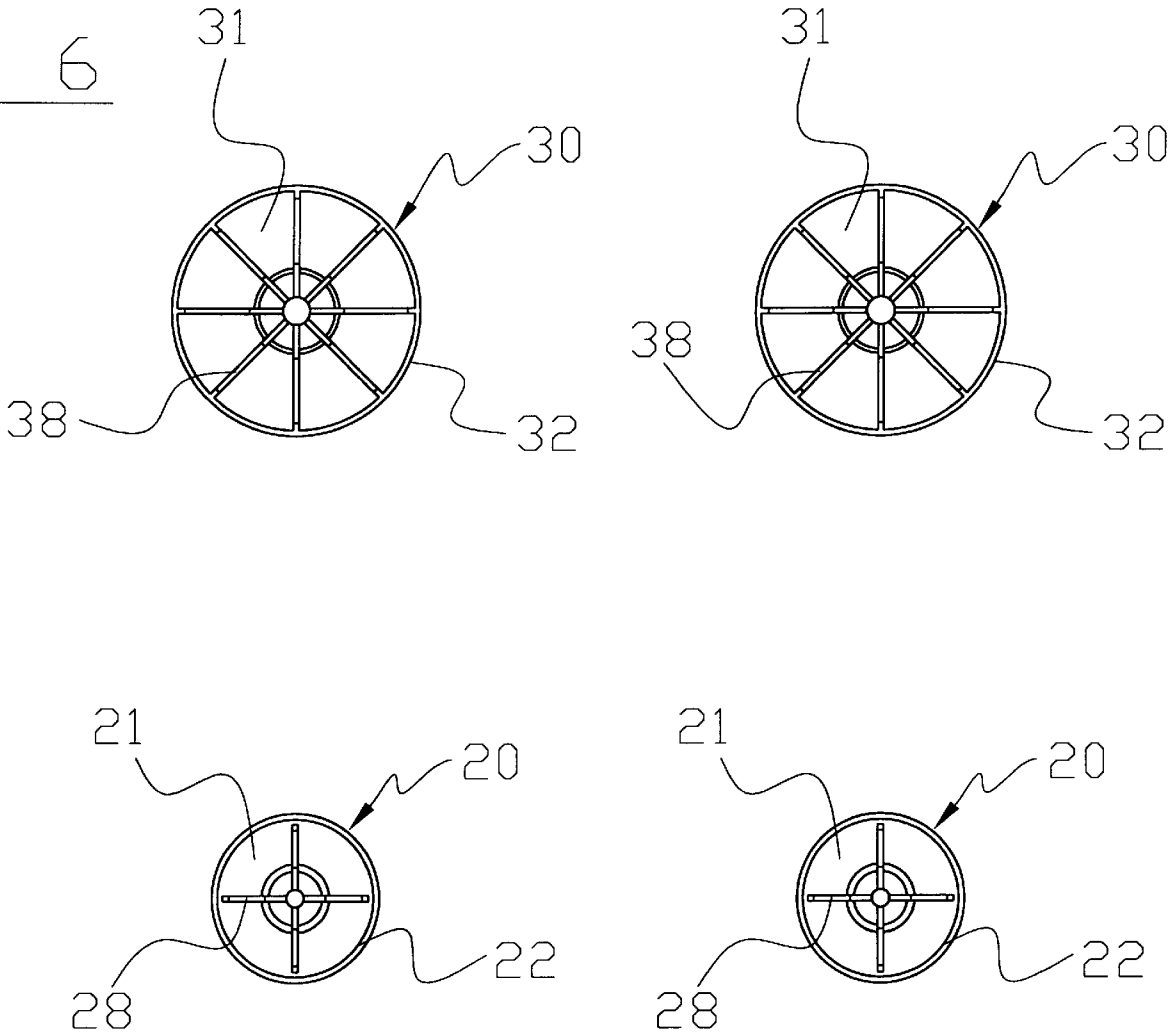
FIG. 6 is a bottom view of the present invention.
Figure 7:
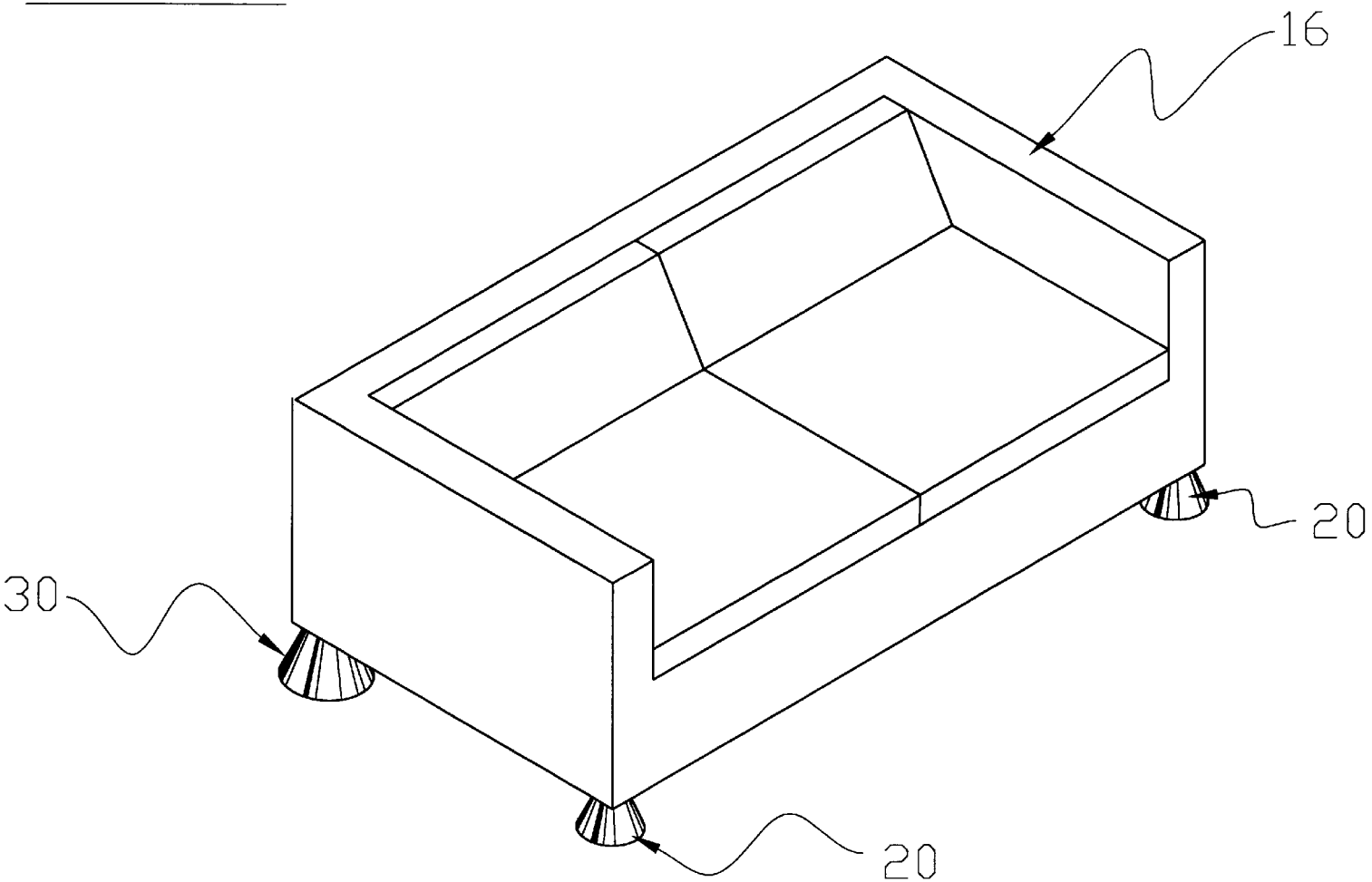
FIG. 7 is an upper perspective view of the present invention positioned beneath a couch.

The first support member 20 preferably is hollow with the first lower end 22 being open to expose the interior cavity of the first support member 20 as shown in FIG. 6 of the drawings. The inner surface of the first support wall 21 preferably includes a plurality of first braces 28 extending from the first lower end 22 to the first upper end 24.

Figure 8:
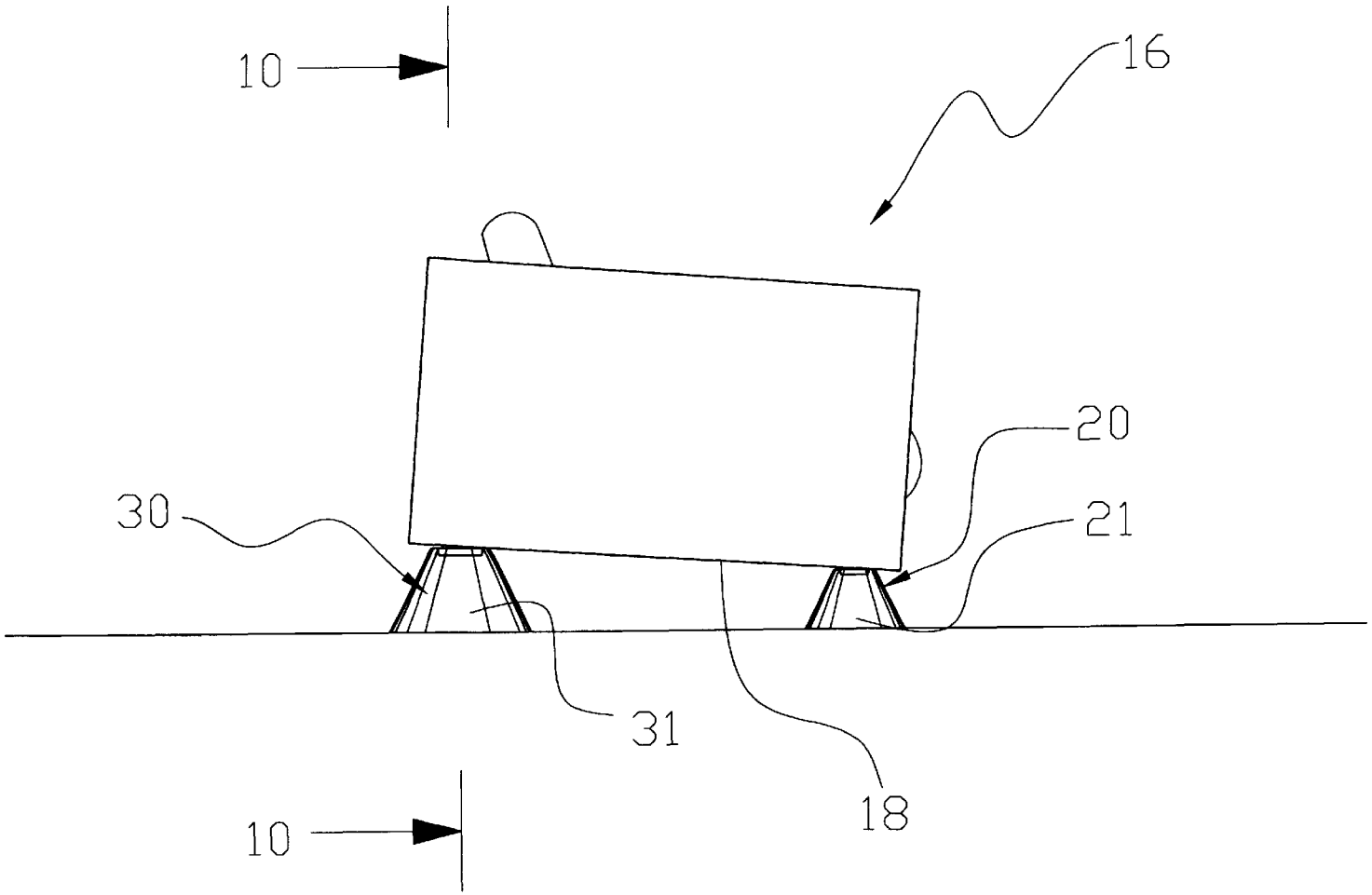
FIG. 8 is a side view of the present invention positioned beneath a couch.

The first support member 20 may have various heights as required to support the furniture at the desired height and forward angle. The first support member 20 is shorter in height than the second support member 30 by at least one inch to provide an elevated forward sloping feature of the furniture as best illustrated in FIGS. 2, 4 and 8 of the drawings.

Figure 5:
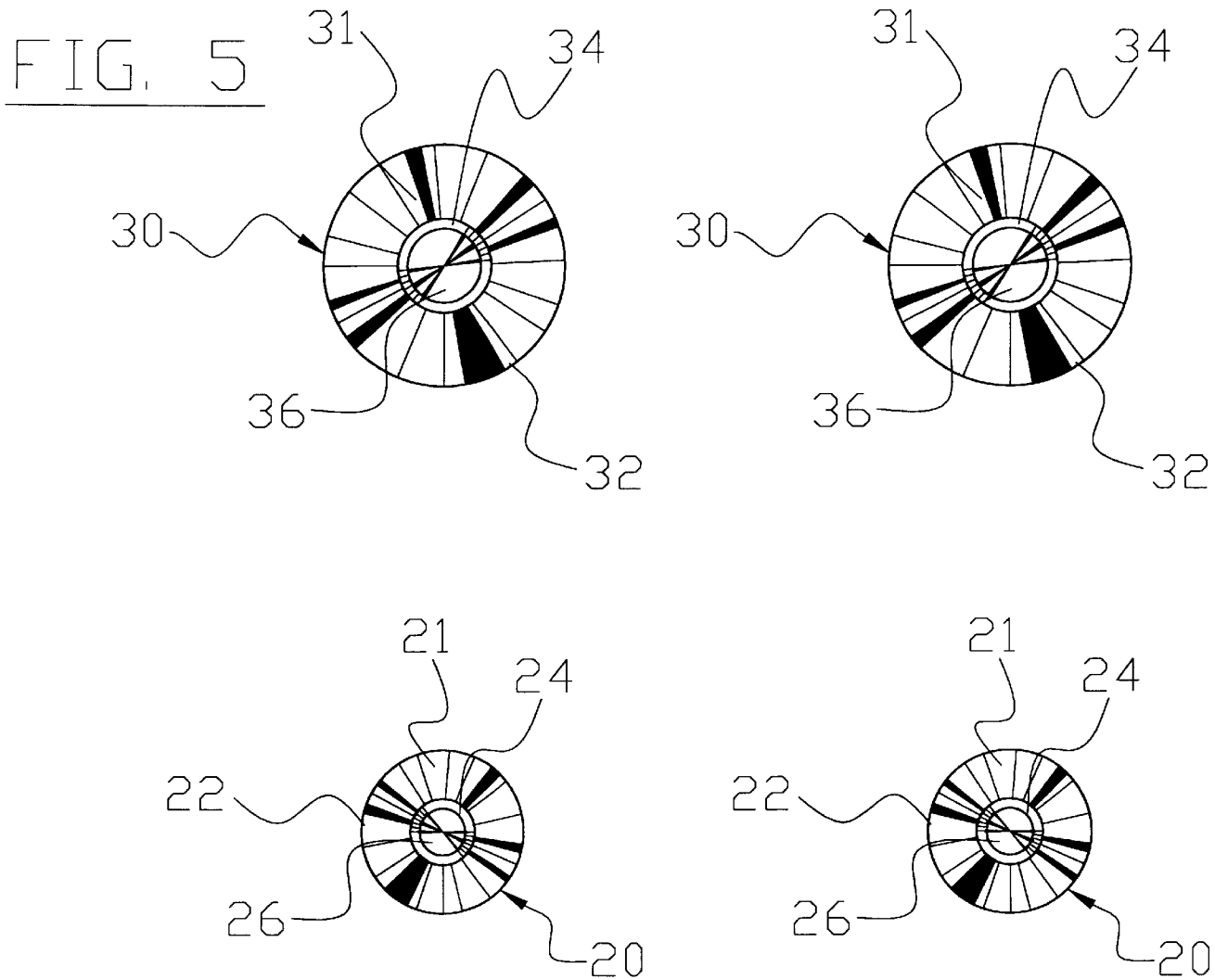
FIG. 5 is a top view of the present invention.
Figure 9:
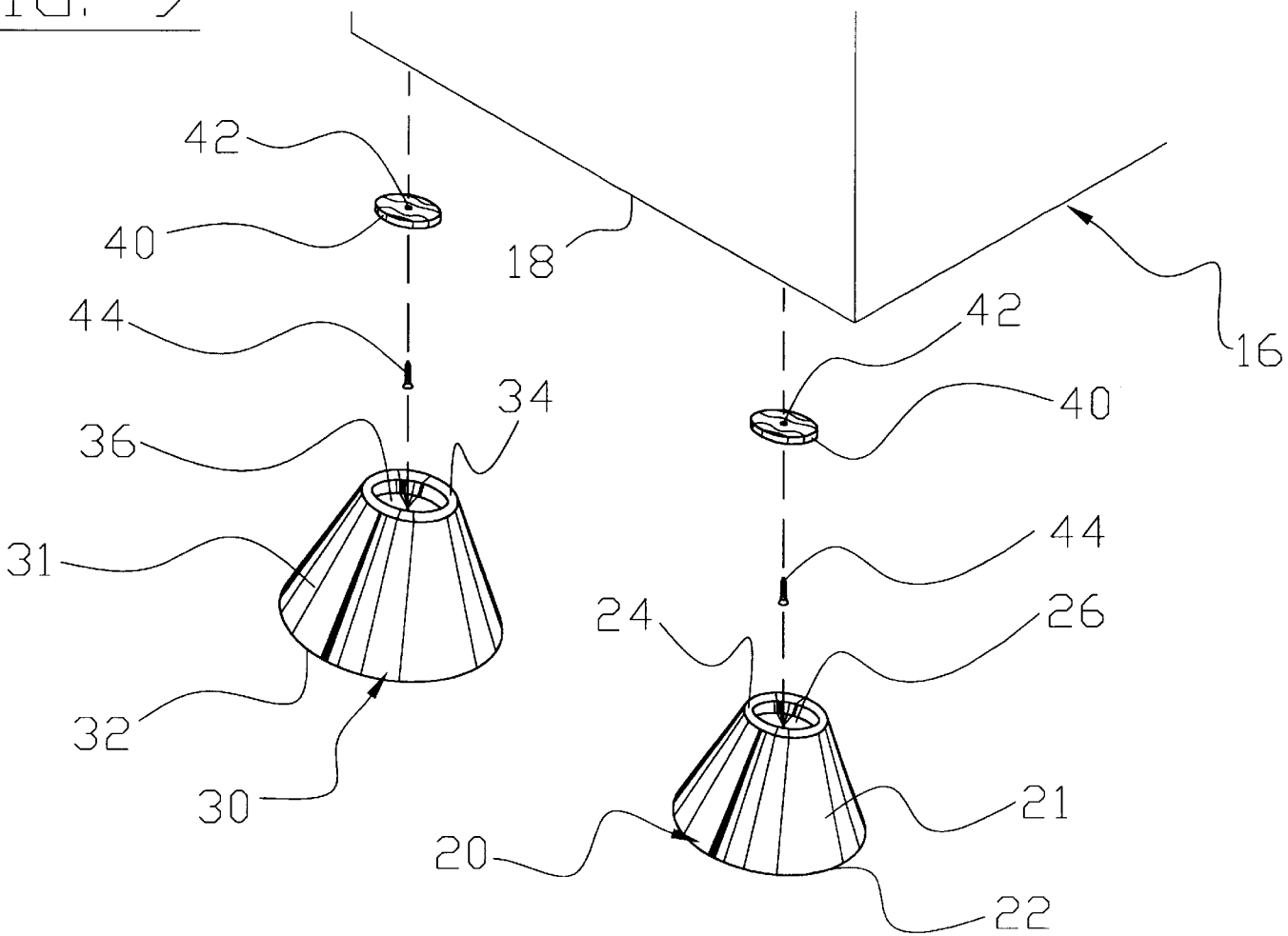
FIG. 9 is an exploded upper perspective view of the first support member, the second support member and a support plate positioned beneath a couch.

The first upper end 24 of the first support member 20 includes a first cavity 26 as best shown in FIGS. 3, 5 and 9 of the drawings. The first cavity 26 is preferably of sufficient depth and width to securely receive the lower end of a leg 14 of a chair 12 or couch 16. The first cavity 26 is preferably similar to the shape of the first upper end 24, however various other shapes may be utilized to construct the first cavity 26 as can be appreciated.

As shown in FIGS. 1 through 5 of the drawings, each second support member 30 is comprised of a tapered structure having a second support wall 31, a broad second lower end 32 and a narrower second upper end 34 similar to the first support member 20. The second lower end 32 is significantly broader than the second upper end as best illustrated in FIG. 4 of the drawings. The second support member 30 preferably has a conical shape, other tapered shapes may be utilized to construct the second support member 30 as can be appreciated. The second support member 30 is preferably constructed of a strong and lightweight material such as but not limited to plastic. The second support member 30 may be painted to match the surrounding furniture or the material utilized to construct the second support member 30 may be colored to the desired color.

Figure 10:
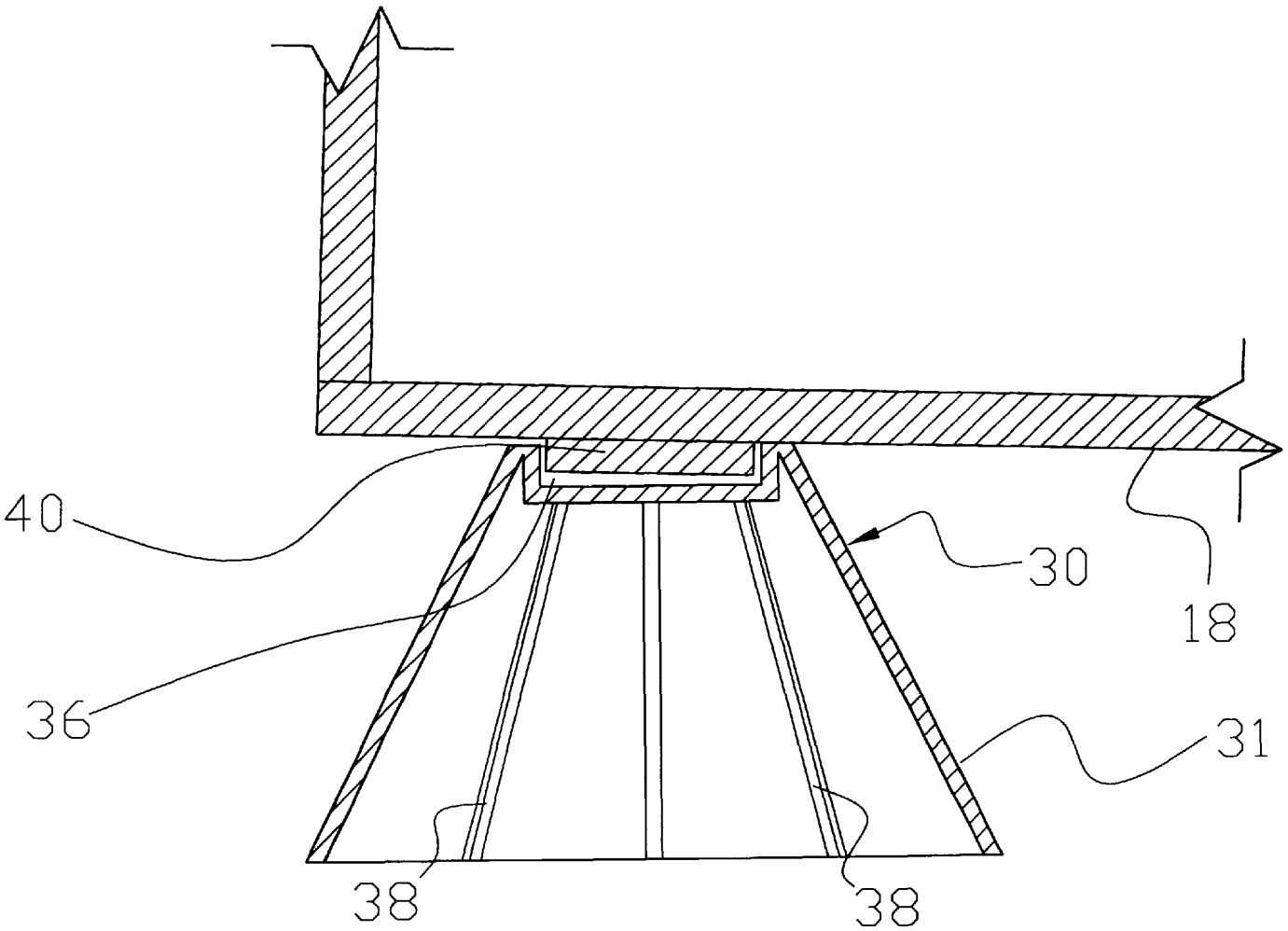
FIG. 10 is a cross sectional view taken along line 10—10 of FIG. 8.

The second support member 30 preferably is hollow with the second lower end 32 being open to expose the interior cavity of the second support member 30 as shown in FIGS. 6 and 10 of the drawings. The inner surface of the second support wall 31 preferably includes a plurality of second braces 38 extending from the second lower end 32 to the second upper end 34.

The second support member 30 may have various heights as required to support the furniture at the desired height and forward angle. The second support member 30 is taller in height than the first support member 20 by at least one inch to provide an elevated forward sloping feature of the furniture as best illustrated in FIGS. 2, 4 and 8 of the drawings.

The second upper end 34 of the second support member 30 includes a second cavity 36 as best shown in FIGS. 3, 5 and 9 of the drawings. The second cavity 36 is preferably of sufficient depth and width to securely receive the lower end of a leg 14 of a chair 12 or couch 16. The second cavity 36 is preferably similar to the shape of the second upper end 34, however various other shapes may be utilized to construct the second cavity 36 as can be appreciated.

A support plate 40 is illustrated in FIGS. 9 and 19 of the drawings that may be utilized upon furniture not having legs 14. The support plate 40 includes a center aperture 42 for receiving a conventional fastener 44 for securing to the bottom edge 18 of a piece of furniture such as but not limited to a couch 16. The support plate 40 is formed to fit within cavities 26, 36 of the support members 20, 30 as best shown in FIG. 10 of the drawings. The support plate 40 has a height slightly shorter than the depth of the cavities 26, 36 to allow the weight of the furniture to be fully supported by the upper perimeter of the upper ends 24, 34 of the support members 20, 30 as best illustrated in FIG. 10 of the drawings. The support plate 40 ensures that the furniture is not accidentally removed from the support members 20, 30 during usage of the furniture.

In use, the user positions at least two first support members 20 beneath the front legs 14 of the furniture such as a chair 12 or couch 16. The legs 14 are positioned within the first cavity 26 of each of the first support members 20 as best shown in FIG. 1 of the drawings. The user then positions the second support members 30 beneath the rear legs 14 of the furniture with the legs 14 of the furniture positioned within the second cavity 36 of each of the second support members 30. Since the second support members 30 are taller than the first support members 20, the furniture is elevated and angled forwardly as shown in FIGS. 2 and 8 of the drawings. If the furniture does not have legs 14 contained thereupon, a plurality of support plates 40 are secured to the bottom edge 18 of the furniture and thereafter positioned within the cavities 26, 36 of the support members 20, 30. The user is then able to easily sit upon the chair 12 or couch 16 without requiring significant effort or assistance. When the user desires to standup from the seated position, since their body is elevated and positioned forwardly they are able to easily standup without the assistance of a third party. When finished utilizing the invention, the support members 20, 30 are simply removed from beneath the furniture and thereafter stored in a convenient location. The support members 20, 30 may be stacked upon one another to provide a compact storage structure when not in use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A furniture support system, comprising:

at least two first support members each having a first upper end, a first cavity within said first upper end, and a first lower end, wherein said first support members are positionable beneath a plurality of front legs of furniture; and at least two second support members each having a second upper end, a second cavity within said second upper end, and a second lower end, wherein said second support members are positionable beneath a plurality of rear legs of furniture and wherein said second support members have a height greater than said first support members;

wherein a width of said upper ends is less than 80 percent of the width of said lower ends of said support members.

2. The furniture support system of claim 1, wherein said height of said second support members is at least one inch greater than said first support members.

3. The furniture support system of claim 1, wherein said first support members and said second support members taper upwardly from said lower ends to said upper ends.

4. The furniture support system of claim 1, wherein said cavities are formed to receive said legs of said furniture.

5. The furniture support system of claim 1, wherein said support members are comprised of at least one support wall.

6. The furniture support system of claim 1, wherein said support members are conical shaped.

7. The furniture support system of claim 1, wherein said support members have an interior cavity.

8. The furniture support system of claim 7, wherein said lower ends of said support members are open exposing said interior cavity.

9. The furniture support system of claim 1, wherein said support members include a plurality of braces.

10. A furniture support system, comprising:

at least two first support members each having a first upper end, a first cavity within said first upper end, and a first lower end, wherein said first support members are positionable beneath a plurality of front legs of furniture; and at least two second support members each having a second upper end, a second cavity within said second upper end, and a second lower end, wherein said second support members are positionable beneath a plurality of rear legs of furniture and wherein said second support members have a height greater than said first support members;

wherein a width of said upper ends is less than 80 percent of the width of said lower ends of said support members;

wherein said height of said second support members is at least one inch greater than said first support members;

wherein said first support members and said second support members taper upwardly from said lower ends to said upper ends;

wherein said cavities are formed to receive said legs of said furniture;

wherein said support members are comprised of at least one support wall;

wherein said support members are conical shaped;

wherein said support members have an interior cavity;

wherein said lower ends of said support members are open exposing said interior cavity;

wherein said support members include a plurality of braces.

11. A furniture support system, comprising:

a plurality of support plates attachable to a bottom edge of furniture;

at least two first support members each having a first upper end, a first cavity within said first upper end, and a first lower end, wherein said first support members are positionable beneath said furniture with one of said plurality of support plates positionable within each first cavity; and at least two second support members each having a second upper end, a second cavity within said second upper end, and a second lower end, wherein said second support members are positionable beneath said furniture with one of said plurality of support plates positionable within each second cavity and wherein said second support members have a height greater than said first support members.

12. The furniture support system of claim 11, wherein said height of said second support members is at least one inch greater than said first support members.

13. The furniture support system of claim 12, wherein said first support members and said second support members taper upwardly from said lower ends to said upper ends.

14. The furniture support system of claim 13, wherein said cavities are formed to receive said legs of said furniture.

15. The furniture support system of claim 14, wherein said support members are comprised of at least one support wall.

16. The furniture support system of claim 15, wherein said support members are conical shaped.

17. The furniture support system of claim 16, wherein said support members have an interior cavity.

18. The furniture support system of claim 17, wherein said lower ends of said support members are open exposing said interior cavity.

19. The furniture support system of claim 11, wherein each of said support plates includes an aperture positioned centrally for receiving a fastener.

20. The furniture support system of claim 19, wherein a height of said support plates is lower than a depth of said cavities.

* * * * *